US005762728A

United States Patent [19]

Kuramasu et al.

[11] Patent Number: 5,762,728

[45] Date of Patent: Jun. 9, 1998

[54] WEAR-RESISTANT CAST ALUMINUM ALLOY PROCESS OF PRODUCING THE SAME

[75] Inventors: Yukio Kuramasu; Akio Hashimoto, both of Shizuoka; Yoji Namekawa; Sanji Kitaoka, both of Tokyo; Koji Watanabe, Yokohama; Kenji Tsushima, Yokosuka; Mamoru Sayashi, Miura, all of Japan

[73] Assignees: Nippon Light Metal Company Ltd., Tokyo; Nissan Motor Co., Ltd., Kanagawa, both of Japan

[21] Appl. No.: 768,666

[22] Filed: Dec. 18, 1996

Related U.S. Application Data

[63] Continuation of Ser. No. 400,846, Mar. 8, 1995.

[30] Foreign Application Priority Data

Mar. 16, 1994 [JP] Japan ..... 6-045963

[51] Int. Cl.[6] ..... B22D 27/04

[52] U.S. Cl. ..... 148/549; 148/439; 164/122

[58] Field of Search ..... 148/439, 549; 420/534, 535, 537, 538, 549, 548; 164/122

[56] References Cited

U.S. PATENT DOCUMENTS 5,494,540 2/1996 Ochi et al. ..... 148/439

FOREIGN PATENT DOCUMENTS 50-64107 5/1975 Japan .
60-75544 4/1985 Japan .
5-78770 3/1993 Japan .

*Primary Examiner*—George Wyszomierski
*Attorney, Agent, or Firm*—McAulay Fisher Nissen Goldberg & Kiel, LLP

[57] ABSTRACT

To provide a wear resistance comparable with that of the conventional A390 series aluminum alloys, a reduced attacking to a sliding counterpart, and an improved machinability, a wear-resistant cast aluminum alloy comprises: a chemical composition consisting, in weight percentage of: 14.0–16.0 Si, 2.0–5.0 Cu, 0.1–1.0 Mg, 0.3–0.8 Mn, 0.1–0.3 Cr, 0.01–0.20 Ti, 0.003–0.02 P, 1. 5 or less Fe, and the balance of Al and unavoidable impurities in which the Ca content is limited to not more than 0.005; and a microstructure in which a primary Si crystal and Al-Si-Fe-MnCr-based intermetallic compounds are dispersed in the form of a crystallized particle having a diameter of from 5 to 30 gm. A process of producing a wear-resistant cast aluminum alloy includes casting a melt of the alloy composition at a cooling rate of from 50° to 200° C./sec.

6 Claims, 4 Drawing Sheets

WEAR-RESISTANT CAST ALUMINUM ALLOY PROCESS OF PRODUCING THE SAME

This is a continuation-in-part continuation, of application Ser. No. 08/400,846 filed March 8, 1995.

BACKGROUND OF THE INVENTION

1. Field of the Invention

The present invention relates to a wear-resistant cast aluminum alloy suitably used as the housing parts of power equipment, etc., and to a process of producing the alloy.

2. Description of the Related Art

A390 series die casting aluminum alloys are used to fabricate the oil pump housing of an automobile transmission or other power equipment which must be wear-resistant.

These aluminum alloys contain 16.0–18.0 wt % Si, 4.0–5.0 wt % Cu, 0.45–0.65 wt % Mg, 1.0 wt % or less Mn, 0.10 wt % or less Zn, 0.20 wt % or less Ti, and 1.3 wt % or less Fe, in which the relatively large amount of Si is used to ensure the necessary wear-resistance.

The increased amount of Si requires that both the melting of source materials and the casting of the melt must be performed at a high temperature, which causes degradation of the castability. The high temperature casting also results in a nonuniform distribution of primary Si and frequent occurrence of shrinkage or other casting defects.

To solve these problems, Japanese Unexamined Pat. Publication (Kokai) No. 50-64107 proposed a reduced Si amount in the range of 13.5–16.0 wt % to ensure good castability and an addition of Cu, Mg, and Zn to provide the necessary hardness and wear-resistance.

Japanese Unexamined Pat. Publication (Kokai) No. 5-78770, by the same applicant, also proposed an alloy containing Si in an amount of 14.0–16.0 wt % and additive elements of Cu, Mn, Mg, Cr, Ti, P, Fe, Ca, etc., in a specified charging proportion, to provide a fine dispersion of primary Si crystals thereby improving the wear resistance and to simultaneously provide a casting free from defects.

Although the castability of A390 series alloys is thus improved, the above-recited alloy designs cannot yet provide good workability, so that A390 series alloys still remain difficult to work.

The primary Si crystals continue to form a hard phase even when finely dispersed. Therefore, A390 series alloys have a drawback that, when used as a sliding member, they attack the counterpart material. To avoid this attack, the counterpart must either be made of a more expensive hard material or be coated with a hard material.

SUMMARY OF THE INVENTION

The object of the present invention is to solve this problem through improving the alloys proposed by the above recited Japanese Unexamined Pat. Publication (Kokai) No. 5-78770, i.e., to provide an alloy which attacks the counterpart to a lesser extent and has improved mechanical properties over A390 alloys by having a reduced diameter of crystallized particles and a reduced amount of the hard primary Si crystal.

To achieve the above object according to the present invention, there is provided wear-resistant cast aluminum alloy comprising:

a chemical composition consisting, in weight percentage of: 14.0–16.0 Si, 2.0–5.0 Cu, 0.1–1.0 Mg, 0.3–0.8 Mn, 0.1–0.3 Cr, 0. 01–0.20 Ti, 0.003–0.02 P, 1.5 or less Fe, and the balance of Al and unavoidable impurities in which the Ca content is limited to not more than 0.005; and a microstructure in which a primary Si crystal and Al-SiFe-Mn-Cr-based intermetallic compounds are dispersed in the form of a crystallized particle having a diameter of from 5 to 30 μm.

According to the present invention, there is also provided a process of producing a wear-resistant cast aluminum alloy comprising the step of:

preparing a melt of an aluminum alloy having a chemical composition consisting, in weight percentage of: 14.0–16.0 Si, 2.0–5.0 Cu, 0.1–1.0 Mg, 0.3–0.8 Mn, 0.1–0.3 Cr, 0.01–0.20 Ti, 0.003–0.02 P, 1.5 or less Fe, and the balance of Al and unavoidable impurities in which the Ca content is limited to not more than 0.005; and casting the melt at a cooling rate of from 50° to 200° C./sec.

An alloy according to the present invention may further contain at least one of 0.0001–0.01 wt % B and 0.3–3.0 wt % Ni.

A cast aluminum alloy according to the present invention has a microstructure composed of an Al-based solid solution matrix containing a uniform dispersion of the crystallized particles of Al-Si-Fe-Mn-Cr system intermetallic compounds and primary Si crystal particles, the particles having a diameter of from 5 to 30 μm. The Al-Si-Fe-Mn-Cr system crystallized particles have a hardness of MHV 300–500 and are softer than the primary Si crystals having a hardness of about MHV 1000. Therefore, the present inventive cast alloy has a low cutting resistance and reduces the tool wear when being machined.

The Al-Si-Fe-Mn-Cr system crystallized particle has a fine, almost cubic shape and is more stable than the large primary Si crystal of the A390 alloys, so that the amount of the particles broken or fallen from the matrix during machining is reduced to provide a small and uniform surface roughness of a machined article.

The amount of the primary Si crystals broken or fallen from the matrix is also reduced to provide a wear resistance comparable with that of the A390 series alloys together with a reduced extent of attacking to the counterpart material.

The fine and uniform dispersion of the particles of Al-Si-Fe-Mn-Cr compounds and primary Si crystal is established in an Al-based matrix by casting a melt at a cooling rate of from 50° to 200° C./sec.

The present inventive cast aluminum alloy has the specified chemical composition for the following reasons.

Si: 14.0–16.0 wt %

The presence of Si is essential to improve the wear resistance and the elastic coefficient. However, when the Si amount is more than 16.0 wt %, the liquid us temperature of the alloy rises and thereby causes a problem that the melting and casting operations become difficult and also nonuniform dispersion of the primary Si crystals often occurs. On the other hand, an Si content of less than 14.0 wt % is too small to ensure good wear resistance.

The Si content of not more than 16.0 wt % also provides a remarkable improvement of the machinability of the alloy, so that the tool life reduction due to wear is eliminated and the machining cost can be significantly reduced. Therefore, the Si content is within the range of from 14.0 to 16.0 wt %, preferably from 14.5 to 15.5 wt %.

Cu: 2.0–5.0 wt %

Cu strengthens the matrix and improves the wear resistance. To ensure this effect, the Cu content must be 2.0 wt % or more. However, a Cu content more than 5.0 wt % causes frequent occurrence of shrinkage defects. Therefore, the Cu content must be within the range of from 2.0 to 5.0 wt %, preferably from 3.0 to 4.0 wt %.

Mg: 0.1–1.0 wt %

Mg is effective in improving hardness, wear resistance and mechanical strength. This effect is obtained when Mg is present in an amount of 0.1 wt % or more. However, when Mg is present in an amount of more than 1.0 wt %, reduction in the toughness of the alloy is often observed. Therefore, the Mg content must be within the range of from 0.1 to 1.0 wt %, preferably from 0.3 to 0.8.

Mn: 0.3–0.8 wt %

Mn strengthens the matrix and improves the mechanical properties. When the Mn content is less than 0.3 wt %, the wear resistance is reduced. On the other hand, a Mn content of more than 0.8 wt % lowers the castability and has an adverse effect on the mechanical properties. Therefore, the Mn content must be within the range of from 0.3 to 0.8 wt %, preferably 0.3 to 0.6 wt %.

Cr: 0.1–0.3 wt %

Cr is essential to provide a fine and uniform dispersion of the primary Si crystals and the Al-Si-Fe-Mn-Cr system intermetallic compound particles and also improves the hardness and the mechanical properties. These effects are significant when the Cr content is 0.1 wt % or more. However, a Cr content of more than 0.3 wt % degrades the castability and the mechanical properties. The presence of Cr in an excessive amount also causes coarsening of the Al-Cr system crystallized particles. Therefore, the Cr content must be within the range of from 0.1 to 0.3 wt %, preferably from 0.1 to 0.2 wt %.

Ti: 0.01–0.20 wt %

Ti is used to refine crystal grains of the alloy and must be present in an amount of 0.01 wt % or more. Ti also improves the mechanical properties. However, a Ti content of more than 0.20 wt % has an adverse effect on the mechanical properties. Therefore, the Ti content must be within the range of from 0.01 to 0.20 wt %, preferably from 0.01 to 0.1 wt %.

P: 0.003–0.02 wt %

P, like Cr, refines the primary Si crystal to form a fine dispersion. This effect on the primary Si crystal is attained when P is present in an amount of 0.003 wt % or more. The P content in this range is also advantageous, because the melt has a low viscosity and good fluidity to improve the castability. However, when P is present in an amount of more than 0.02 wt %, the melt fluidiy and other castability parameters are degraded. Therefore, the P content must be within the range of from 0.003 to 0.02 wt %, preferably from 0.004 to 0.01 wt %.

Fe: 1.5 wt % or less

Fe is one of the impurities introduced into the alloy composition during the melting process. When Fe is contained in a large amount, Al-Fe, Al-Fe-Mn-Si, and other compounds are formed, particularly at the slowly cooled portions and hot spots, causing formation of microporosities with the result that the cast aluminum alloy article has poor toughness and strength. It should be noted, however, that Fe is effective to prevent a high temperature alloy melt from adhering to the die wall during a die-casting process. Thus, Fe is preferably present in an amount of 0.1 wt % or more when the alloy is used as a diecast article. Therefore, the Fe content must be 1.5 wt % or less, preferably within the range of from 0.1 to 1.0 wt %.

Ca: 0.005 wt % or less

Ca, like Fe, is another one of the impurities introduced into the alloy composition during the melting process. When the Ca content is more than 0.005 wt %, a large inner shrinkage is formed and the castability of the alloy is degraded. Ca has another drawback that it impedes the effect of P to refine the primary Si crystals.

B: 0.0001–0.01 wt %

B is an optional additive element to refine the crystal grains, like Ti. This effect is obtained when B is present in an amount of 0.0001 wt % or more. However, because an excessive amount of B induces embrittlement of the alloy, the upper limit of the B content must be 0.01 wt %. Therefore, B is optionally used in an amount of from 0.0001 to 0.01 wt %, preferably from 0.0001 to 0.003 wt %.

Ni: 0.3–3.0 wt %

Ni is another optional additive element to improve the high temperature strength, the hardness, and the wear resistance. These effects are attained when Ni is present in an amount of 0.3 wt % or more. However, it is not desirable to use the expensive Ni source material from the viewpoint of increased cost of the alloy. It is also disadvantageous that the corrosion resistance of the alloy is reduced as the Ni content is increased. To avoid this drawback, the upper limit of the Ni content is set at 3.0 wt % under the provision that the useful effect of Ni is partly replaced or assisted by the presence of Mn. Therefore, Ni is optionally used in an amount of from 0.3 to 3.0 wt %, preferably from 0.3 to 0.6 wt %.

The cast aluminum alloy according to the present invention usually contains Zn, which is an impurity element introduced from the source materials. Zn degrades the corrosion resistance and the Zn content is desirably as small as possible. From this point of view, the Zn content is restricted to not more than 1.5 wt %, preferably not more than 0.1 wt %.

Diameter of primary Si crystal and Al-Si-Fe-Mn-Cr compound particles: 5–30 μm

To provide good wear resistance, machinability and castability, it is necessary to control the average diameter of the primary Si crystals and the Al-Si-Fe-Mn-Cr compound particles within the range of from 5 to 30 μm. When the average diameter of these particles is less than 5 μm, their effect to improve the wear resistance is lost. On the other hand, when the average diameter is more than 30 μm, breaking and falling of these particles occur during machining and the machinability is reduced and moreover, the mechanical properties and the wear resistance are also degraded. Particularly, when the primary Si crystal has a diameter of more than 30 μm, the cutting resistance is so high as to cause the material to be plucked off. Therefore, the particles of the primary Si crystal and the Al-Si-Fe-Mn-Cr compound must have a diameter within the range of from 5 to 30 μm, preferably from 5 to 20 μm.

Cooling rate of melt during casting: 50°–200° C./sec

To provide a uniform dispersion of the primary Si crystal and the Al-Si-Fe-Mn-Cr compound as particles having an average diameter of from 5 to 30 μm, the melt must be cooled at a rate in the range of from 50° to 200° C./sec during casting. When the cooling rate is less than 50° C./sec, the growth of the crystallized particles is accelerated to form coarse particles having a diameter of more than 30 μm and the particles are also nonuniformly dispersed, with the result that the cast alloy has poor wear resistance. On the other hand, when the cooling rate is more than 200° C./sec, the crystallized particles have too small a diameter to provide good wear resistance. Therefore, the melt cooling rate during casting must be within the range of from 50° to 200° C./sec, preferably from 100° to 200° C./sec.

The melt cooling rate varies with the section size of the cast product even in the same casting process. Therefore, an optimal casting process is selected to ensure a melt cooling rate within the specified range of from 50° to 200° C./sec in accordance with the section size of the cast product.

DESCRIPTION OF THE PREFERRED EMBODIMENTS

EXAMPLE 1

Two aluminum alloys having different chemical compositions summarized in Table 1 were cast by using various cooling rates. In Table 1, the hypereutectic Al-Si alloy has a chemical composition within the specified range and the comparative alloy is a commercially available A390 alloy.

Figure 1:
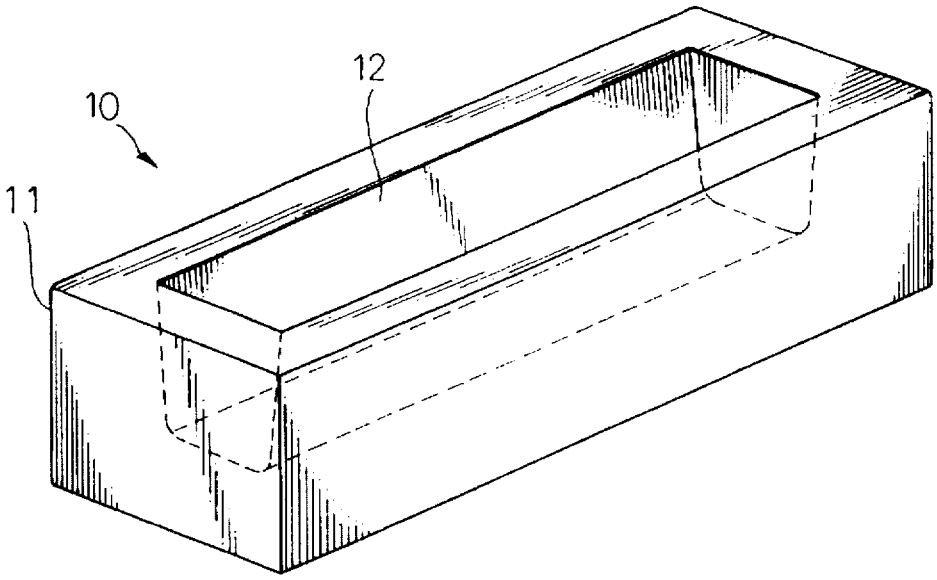
FIG. 1 shows a boat-shaped casting mold made of cast iron used for carrying out a casting process according to an embodiment of the present invention, in a perspective view.
Figure 2A:
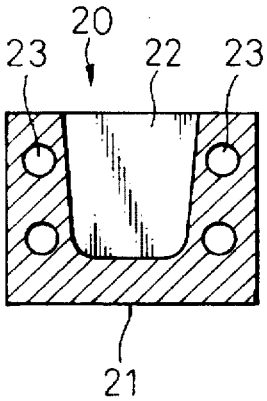
FIGS. 2(*a*) and 2(*b*) show a boat-shaped water-cooled casting mold made of copper used for carrying out a casting process according to an embodiment of the present invention, in cross-sectional views.
Figure 2B:
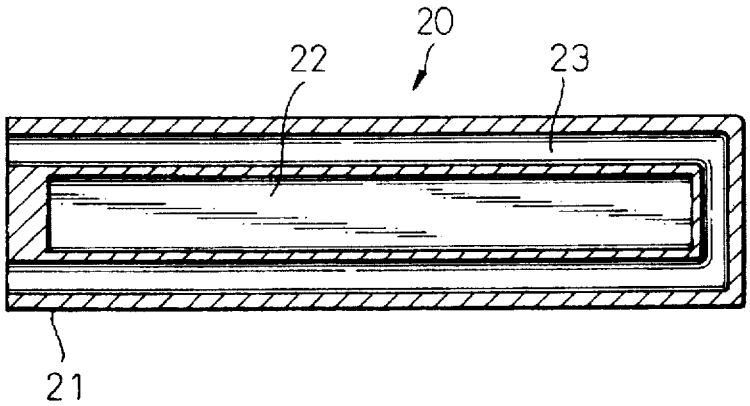
Figure 3:
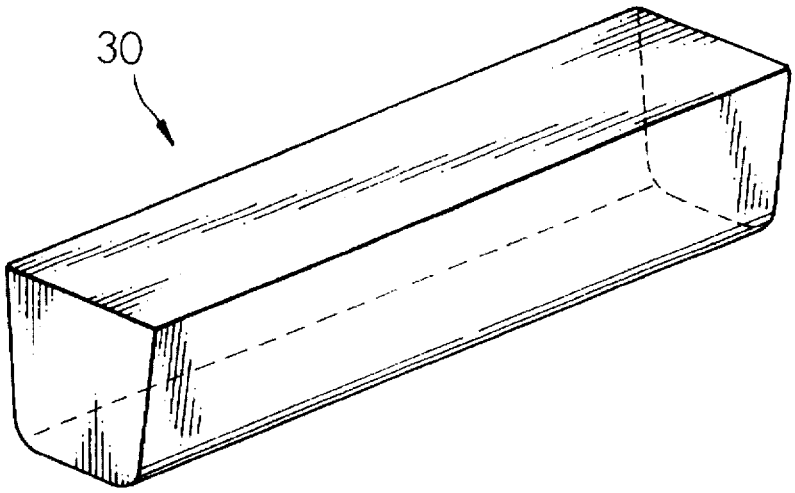
FIG. 3 shows a cast article by a casting process using the boat-shaped mold, in a perspective view.
Figure 4:
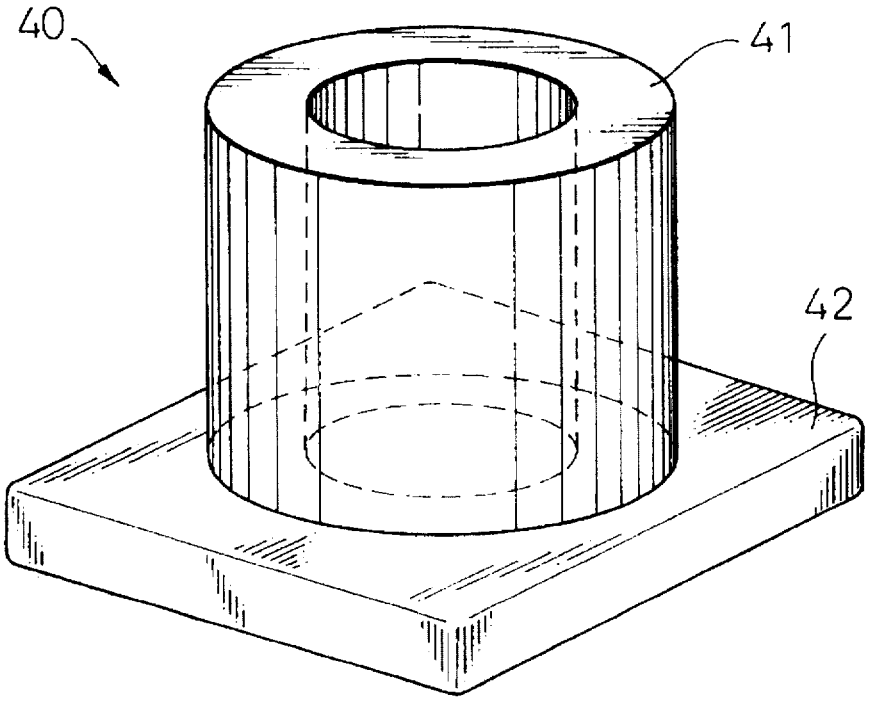
FIG. 4 shows a sleeve-shaped heat-insulation casting mold used for carrying out a process according to an embodiment of the present invention.

To study the influence of the melt cooling rate on the microstructure and the properties of the cast aluminum alloy articles, a boat-shaped cast iron mold, a boat-shaped copper mold, and a sleeve-shaped heat-insulated mold were used. FIG. 1 shows a boat-shaped cast iron mold 10 in the form of a 240 mm long, 75 mm wide, 60 mm high rectangular parallelopiped 11 having a 200 mm long, 35 mm wide, 40 mm high cavity 12. FIG. 3 shows the boat-shaped copper mold 20 in the form of a 240 mm long, 75 mm wide, 60 mm high rectangular parallelopiped 21 having a 200 mm long, 35 mm wide, 40 mm high cavity 21 and two lines of 10 mm in diameter cooling water paths 23 surrounding the cavity. These boat-shaped molds yield the 200 mm long, 35 mm wide, 40 mm high boat-shaped cast article 30 shown in FIG. 3. FIG. 4 shows the sleeve-shaped heat-insulated mold 40 fabricated of an alumina-silica fiber heat-insulated cylindrical sleeve 41 having an inner diameter of 25 mm and an outer diameter of 100 mm placed on and fixed to a steel chill plate 42. This mold yields a cylindrical cast article having a diameter of 25 mm and a height of 100 mm.

Figure 5:
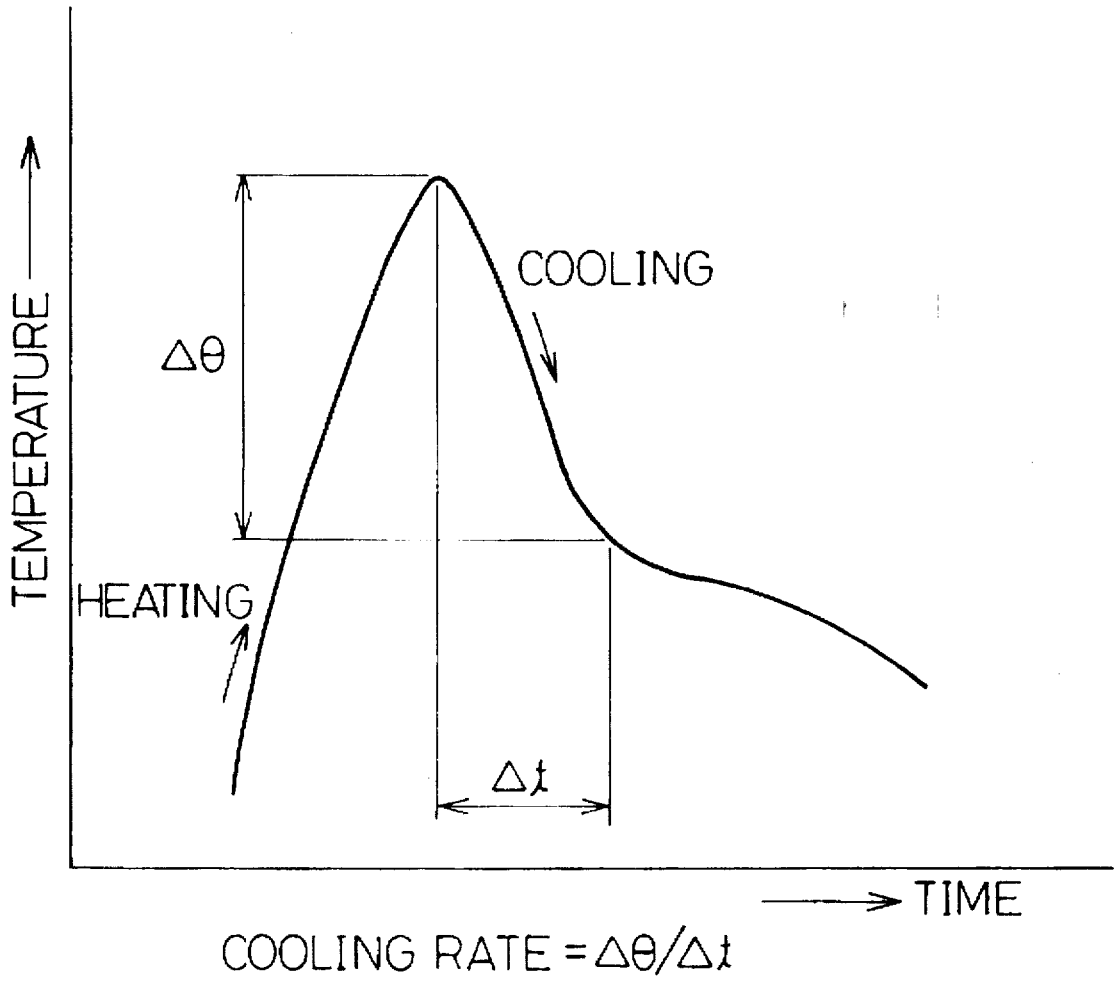
FIG. 5 is a schematic diagram of a heating and cooling curve showing the principle of calculating the cooling rate.

A melt of the aluminum alloy was poured into the mold, the temperature of the melt in the mold was monitored by a thermocouple and the measured temperature change relative to the elapsed time was used to calculate a cooling rate of the melt immediately before passing the liquid us line of the alloy. The thermocouple was placed at the longitudinal center 5 mm above the bottom of the mold cavity of the boat-shaped molds 10 and 20, or on the center axis 30 mm, 60 mm and 90 mm above the bottom of the sleeve-shaped heat-insulated cylindrical mold 40. The cooling rate was determined by a temperature drop $\Delta\theta$ from the highest temperature in a time interval $\Delta t$ as shown in FIG. 5.

Aluminum alloy melts were prepared at a constant melting temperature of 760° C. and were cast at a constant pouring temperature of 700° C., in which different cooling rates were obtained by the different mold conditions. Specifically, the cast iron mold 10 was preheated in an oven at a preset temperature for 1 hour prior to being used to cast the melt therein. The copper mold 20 was cooled by flowing a cooling water there through at different flow rates for 5 min prior to being used to cast the melt. The sleeve-shaped heat-insulated mold 40 was prepared by preheating the steel chill plate 42 at 200° C. for 1 hour in an oven while the alumina-silica fiber heat-insulated cylindrical sleeve 41 was preheated at 100° C. for 1 hour in an oven, and the preheated sleeve 41 was then placed on the preheated plate 42 prior to being used to cast the melt.

Table 2 shows the thus-obtained different cooling rates in the respective casting runs. The hypereutectic Al-Si alloy shown in Table 1 was used both in the inventive group and the comparative group 1 whereas the comparative alloy, which does not contain Cr, of Table 1 was used in the comparative group 2.

Figure 6:
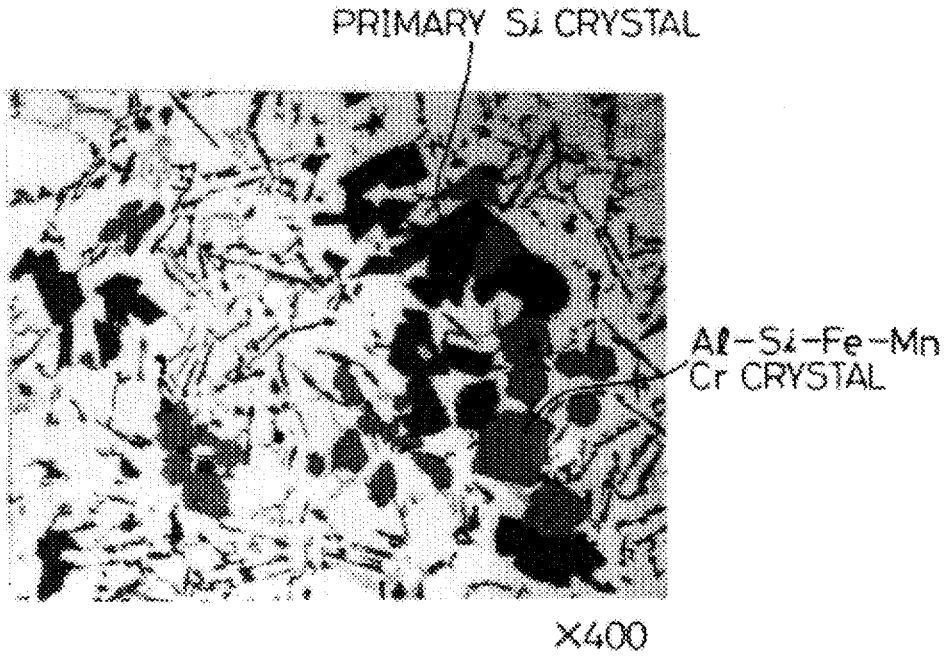
FIG. 6 is an optical photomicrograph showing a microstructure a cast aluminum alloy according to the present invention.

The relationship between the cooling rate and the diameter of the crystallized particles of the cast sample was summarized in Table 3, from which it can be seen that, in the Cr-containing hypereutectic alloy, both the primary Si crystal and the Al-Si-Fe-Mn-Cr crystal had a particle diameter within the range of from 5 to 30 μm when the cooling rate was within the range of from 50° to 200° C./sec. The cast samples had an as-cast microstructure including the crystallized particles uniformly dispersed in the Al-based solid solution matrix, as shown in FIG. 6. The comparative group 1 demonstrates that the crystallized particles were increased in size as the cooling rate was reduced. The comparative group 2, which did not contain Cr, had no Al-SiFe-Mn-Cr crystals.

Test pieces cut from the cast samples were subjected to a wear test and machining test.

The wear test was performed by using a Frictron type wear tester at a wear speed of 10 mm/sec under a pressing load of 3.0 kgf/cm$^2$ in a sliding distance of 1500 m. The counterpart material was a cast iron surface-hardened by Parkerizing (Registered Trade Mark of Parker Rust Proof Inc., USA).

The test results are summarized in Table 4, from which it can be seen that the samples according to the present invention, which had a crystallized particle diameter within the range of from 5 to 30 μm, exhibited a small wear amount of both the cast aluminum alloy test piece and the cast iron counterpart, specifically, the total wear amount was far less than 1.40 mg at the most. In contrast, the samples from the comparative group 1 having the same chemical composition and the larger crystallized particle size showed a total wear amount more than 1.40 mg. Moreover, some samples from the group 2, which contain no Al-Si-Fe-Mn-Cr intermetallic compound particles, exhibited a total wear amount more than 2.0 mg.

The machining test was performed in a lathe using a cemented carbide cutting tool at a constant circumferential speed, a cutting speed of 200 mm/min, a feed speed of 0.3 mm/rev., a cutting depth of 0.7 mm, and a cutting length of 10,000 m.

The test results are summarized in Table 5, from which it can be seen that the samples according to the present invention, which had a crystallized particle diameter within the range of from 5 to 30 μm, exhibited small values of both the tool wear and the cutting resistance. The comparative group 1 demonstrates that both the tool wear and the cutting resistance are sharply increased as the crystallized particle size is increased. The comparative group 2, which contains no Al-Si-FeMn-Cr intermetallic compound crystals, also showed similarly large values of the tool wear and the cutting resistance. In Table 5, the tool wear is expressed in terms of the flank wear and the cutting resistance is expressed in terms of the sum of the cutting, thrust and feed forces in Newton.

As described above, the present invention provides a cast aluminum alloy having an as-cast structure including a fine uniform dispersion of the primary Si crystal and the Al-Si-FeMn-Cr crystallized particles both having a diameter within the range of from 5 to 30 μm, the alloy thereby having a wear resistance comparable with that of the conventional A390 series aluminum alloys, a reduced attacking to the sliding counterpart, and an improved machinability.

TABLE 1

Chemical Compositions (wt %)

| Alloying Element | Inventive Hypereutectic Al—Si Alloy | Comparative A390 Alloy |
|---|---|---|
| Si | 14.9 | 16.9 |
| Cu | 3.1 | 4.5 |
| Mg | 0.79 | 0.56 |
| Fe | 0.85 | 1.0 |
| Mn | 0.47 | 0.48 |
| Cr | 0.19 | — |
| P | 0.0073 | 0.0073 |
| Ti | 0.03 | 0.03 |
| Ca | 0.004 | 0.004 |

TABLE 2

Casting Conditions

| Group | Test No. | Cooling Rate (°C./sec) | Casting Mold (See note below) | Cooling Condition |
|---|---|---|---|---|
| Invention | A1 | 195 | Water-Cooled Cu | Flow rate = 20 l/min |
| | A2 | 121 | Water-Cooled Cu | Flow rate = 10 l/min |
| | A3 | 52 | Water-Cooled Cu | Flow rate = 1 l/min |
| Comparison 1 | B1 | 19 | Preheated Fe | Preheated at 150° C. |
| | B2 | 5.1 | Preheated Fe | Preheated at 250° C. |
| | B3 | 3.5 | Preheated Fe | Preheated at 350° C. |
| | B4 | 2.1 | Heat-Insulated | 30 mm above bottom |
| | B5 | 0.9 | Heat-Insulated | 60 mm above bottom |
| | B6 | 0.5 | Heat-Insulated | 90 mm above bottom |
| Comparison 2 | C1 | 191 | Water-Cooled Cu | Flow rate = 20 l/min |
| | C2 | 129 | Water-Cooled Cu | Flow rate = 10 l/min |
| | C3 | 51 | Water-Cooled Cu | Flow rate = 1 l/min |
| | C4 | 24 | Preheated Fe | Preheated at 150° C. |
| | C5 | 5.9 | Preheated Fe | Preheated at 250° C. |
| | C6 | 3.2 | Preheated Fe | Preheated at 350° C. |
| | C7 | 1.9 | Heat-Insulated | 30 mm above bottom |
| | C8 | 0.8 | Heat-Insulated | 66 mm above bottom |
| | C9 | 0.4 | Heat-Insulated | 90 mm above bottom |

Note)
"Water-Cooled Cu": Boat-shaped water-cooled copper mold.
"Preheated Fe": Boat-shaped cast iron mold.
"Heat-Insulated": Sleeve-shaped heat-insulated mold.

TABLE 3

Cooling Rate vs. Crystallized Particle Size

| Group | Test No. | Cooling Rate (°C./sec) | Crystallized Particle Size: Primary Si | Crystallized Particle Size: Al—Si—Fe—Mn—Cr |
|---|---|---|---|---|
| Invention | A1 | 195 | 5–10 | 5–15 |
| | A2 | 121 | 7–12 | 7–15 |
| | A3 | 52 | 11–29 | 6–19 |
| Comparison 1 | B1 | 19 | 12–39 | 7–23 |
| | B2 | 5.1 | 12–46 | 6–31 |
| | B3 | 3.5 | 14–54 | 9–34 |
| | B4 | 2.1 | 15–56 | 13–37 |
| | B5 | 0.9 | 40–90 | 25–65 |
| | B6 | 0.5 | 55–15 | 31–75 |
| Comparison 2 | C1 | 191 | 5–18 | No Crystals |
| | C2 | 129 | 7–25 | No Crystals |
| | C3 | 51 | 10–32 | No Crystals |
| | C4 | 24 | 12–42 | No Crystals |
| | C5 | 5.9 | 11–46 | No Crystals |
| | C6 | 3.2 | 24–63 | No Crystals |
| | C7 | 1.9 | 27–75 | No Crystals |
| | C8 | 0.8 | 55–10 | No Crystals |
| | C9 | 0.4 | 65–17 | No Crystals |

TABLE 4

Wear Amount

| Group | Test No. | Wear Amount (mg): Al Alloy | Wear Amount (mg): Counterpart | Wear Amount (mg): Total |
|---|---|---|---|---|
| Invention | A1 | 0.59 | 0.61 | 1.20 |
| | A2 | 0.58 | 0.62 | 1.20 |
| | A3 | 0.61 | 0.60 | 1.21 |
| Comparison 1 | B1 | 0.61 | 0.79 | 1.40 |
| | B2 | 0.69 | 0.80 | 1.49 |
| | B3 | 0.71 | 0.90 | 1.61 |
| | B4 | 0.71 | 1.04 | 1.75 |
| | B5 | 0.75 | 1.03 | 1.78 |
| | B6 | 0.74 | 1.12 | 1.86 |
| Comparison 2 | C1 | 0.62 | 0.85 | 1.47 |
| | C2 | 0.61 | 0.86 | 1.47 |
| | C3 | 0.59 | 0.88 | 1.47 |
| | C4 | 1.25 | 1.29 | 2.54 |
| | C5 | 1.23 | 1.35 | 2.58 |
| | C6 | 1.29 | 1.56 | 2.85 |
| | C7 | 1.28 | 1.66 | 2.94 |
| | C8 | 1.27 | 1.86 | 3.13 |
| | C9 | 1.28 | 1.92 | 3.20 |

TABLE 5

Tool Wear and Cutting Resistance

| Group | Test No. | Tool Wear (mm) | Cutting Resistance (N) |
|---|---|---|---|
| Invention | A1 | 0.75 | 278 |
| | A2 | 0.76 | 280 |
| | A3 | 0.81 | 282 |
| Comparison 1 | B1 | 1.12 | 350 |
| | B2 | 1.13 | 356 |
| | B3 | 1.13 | 371 |
| | B4 | 1.21 | 395 |
| | B5 | 1.53 | 452 |
| | B6 | 1.82 | 475 |
| Comparison 2 | C1 | 1.42 | 392 |
| | C2 | 1.46 | 425 |
| | C3 | 1.52 | 442 |
| | C4 | 2.09 | 597 |

TABLE 5-continued

Tool Wear and Cutting Resistance

| Group | Test No. | Tool Wear (mm) | Cutting Resistance (N) |
|---|---|---|---|
| | C5 | 2.13 | 598 |
| | C6 | 2.35 | 605 |
| | C7 | 2.44 | 625 |
| | C8 | 3.21 | 756 |
| | C9 | 3.75 | 785 |

We claim:

1. A process for producing a wear-resistant cast hypereutectic aluminum-silicon alloy comprising the steps of:

preparing a melt of an aluminum alloy having a composition, in weight percentages consisting essentially of:

| | |
|---|---|
| Si | 14.0–16.0 |
| Cu | 2.0–5.0 |
| Mg | 0.1–1.0 |
| Mn | 0.3–0.8 |
| Cr | 0.1–0.3 |
| Ti | 0.01–0.20 |
| P | 0.003–0.02 |
| Fe | 0.1 to 1.0, |

and the balance of Al and unavoidable impurities in which the Ca content is limited to not more than 0.005; and casting said melt at a cooling rate of from 50° to 200° C./sec to establish a fine and uniform microstructure in which a primary Si crystal and disposed particles of Al-Si-Fe-Mn-Cr-based intermetallic compounds are dispersed in the form of crystallized particles having a diameter of from 5 to 30 pm.

2. The process as claimed in claim 1, wherein the aluminum alloy also contains at least one of 0.0001–0.01 wt % B and 0.3–3.0 wt % to Ni.

3. The process as claimed claim 1, wherein the Al-Si-Fe-Mn-Cr crystalized particle has a substantially cubic shape.

4. The process as claimed in claim 1, wherein the wear-resistant cast hypereutectic aluminum-silicon alloy has a wear amount less than 1.40 mg when using a friction type wear tester at a wear speed of 10 μmm/sec under a pressing load of 3.0 kgf/cm$^2$ in a sliding distance of 1500 m.

5. The process as claimed in claim 1, wherein the wear-resistant cast hypereutectic aluminum-silicon alloy has a flank wear less than 1.12 mm based on a machining test performed in a lathe using a cemented carbide cutting tool at a constant circumferential speed, a cutting speed of 200 mm/min a feed speed of 0.3 mm/rev., a cutting depth of 0.7 mm. and a cutting length of 10.000 m.

6. The process as claimed in claim 1, wherein the wear-resistant cast hypereutectic aluminum-silicon alloy has a flank cutting resistance of less than 350 N based on a machining test performed in a lathe using a cemented carbide cutting tool at a constant circumferential speed, a cutting speed of 200 mm/min. a feed speed of 0.3 mm/rev., a cutting depth of 0.7 mm. and a cutting length of 10.000 m.

* * * * *